US007207563B2

(12) United States Patent
Samberg

(10) Patent No.: US 7,207,563 B2
(45) Date of Patent: Apr. 24, 2007

(54) PROCESS FOR REMOVING ELEMENT OF CHANCE FROM GAMES OF SKILL

(76) Inventor: Charles Samberg, 4220 Fox Trace, Boynton Beach, FL (US) 33436

( * ) Notice: Subject to any disclaimer, the term of this patent is extended or adjusted under 35 U.S.C. 154(b) by 132 days.

(21) Appl. No.: 10/857,904

(22) Filed: Jun. 2, 2004

(65) Prior Publication Data

US 2005/0269778 A1 Dec. 8, 2005

(51) Int. Cl.
*A63F 1/00* (2006.01)

(52) U.S. Cl. ..... 273/292; 273/274; 273/236

(58) Field of Classification Search ..... 273/292, 273/274, 146, 309, 236; 463/12, 13
See application file for complete search history.

(56) References Cited

U.S. PATENT DOCUMENTS

| | | | | |
|---|---|---|---|---|
| 3,689,071 | A | 9/1972 | Kucera | |
| 3,777,410 | A | 12/1973 | Robinson | |
| 4,181,308 | A | 1/1980 | Fox et al. | |
| 4,219,197 | A | 8/1980 | Acuff | |
| 4,223,893 | A | 9/1980 | Shane et al. | |
| 4,230,321 | A | 10/1980 | Smith | |
| 4,314,336 | A | 2/1982 | Bernstein et al. | |
| 4,355,812 | A | 10/1982 | McCullough | |
| 4,886,272 | A | 12/1989 | Adise | |
| 4,900,027 | A | 2/1990 | Sheridan | |
| 4,968,030 | A | 11/1990 | Frymire | |
| 5,125,660 | A * | 6/1992 | Stahl | 273/146 |
| 5,370,397 | A | 12/1994 | Miller, Jr. et al. | |
| 5,380,012 | A | 1/1995 | Jones et al. | |
| 5,467,995 | A | 11/1995 | Miller et al. | |
| 5,486,005 | A | 1/1996 | Neal | |
| 5,601,488 | A | 2/1997 | Kadlic | |
| 5,603,502 | A * | 2/1997 | Nakagawa | 273/292 |
| 5,816,576 | A | 10/1998 | Aramapakul et al. | |
| 5,853,325 | A | 12/1998 | Kadlic | |
| 5,879,233 | A * | 3/1999 | Stupero | 463/11 |
| 6,174,237 | B1 | 1/2001 | Stephenson | |
| 6,224,486 | B1 | 5/2001 | Walker et al. | |
| 6,257,681 | B1 | 7/2001 | New | |
| 6,572,111 | B1 | 6/2003 | Samberg | |
| 2002/0113371 | A1 | 8/2002 | Snow | |
| 2003/0053679 | A1 | 3/2003 | Snow | |
| 2003/0070178 | A1 * | 4/2003 | Boyd et al. | 725/110 |

OTHER PUBLICATIONS

Family Feud Wikipedia, Original Show Jul. 1976, 'Home versions of the show', computer version 1983, online version 1999, http://en.wikipedia.org/wiki/Family_Feud.*

"Family Feud New 8th Edition", Milton Bradley, 1985, www.hasbro.com/common/instruct/FamilyFeud8thedition(1985).PDF.*

National Horseshoe Pitchers association web page (3 pages) (www.horseshoepitching.com).

Madison Backgammon Club web site (4 pages) (Google search on madison backgammon club point system).

* cited by examiner

*Primary Examiner*—Benjamin Layno
(74) *Attorney, Agent, or Firm*—Hoffman, Wasson and Gitler, P.C.

(57) ABSTRACT

A system for determining the skill of a player eliminates the element of chance by comparing players who have the same initial position. In the case of cards, the initial position is the hand dealt to the player and in tile games, it is the initial distribution and arrangement of tiles. A player with a less than advantageous initial position may win a game over an opponent having a better initial position. It cannot conclusively be said whether this win is due to the good play of the winner or the bad play of the loser. However, it can clearly be said that the winning player has a higher skill level than the losing player.

7 Claims, No Drawings

PROCESS FOR REMOVING ELEMENT OF CHANCE FROM GAMES OF SKILL

BACKGROUND OF THE INVENTION

Most physical activities, such as athletics, are games of skills. Skills of the players are developed over long periods of time, aided by the person's natural ability. Other games and tasks require mental acuity, strategy and decision making. These skills also are developed over a period of time and vary from player to player. Many of these games and tasks necessarily incorporate an element of chance, normally referred to by the term "luck". The element of chance is random, unpredictable and independent of the player's level of skill.

The element of chance most noticeable occurs in the initial position a player receives due to the random order of pieces used to play a game, but also continues throughout a game, such as the roll of dice governing the movement of pieces. Initial position includes the hand dealt to a player in a game of cards, tile distribution and arrangement in tile games such as Scrabble® and Mahjongg. Even when the initial position of a player is unfavorable, the player's skill in maximizing the outcome given the initial position is indicative of the skill level of that player.

It is undeniable, however, that the element of chance has a bearing on the ultimate success of a player. When a player engages in a game of chance and skill over a great period of time, the general level of skill of that player becomes apparent. One example is a professional poker player who demonstrates an ability to having a winning percentage greater than that of other, average players. These players fair well at tournaments and when such players are grouped together, the players fair well against each other.

There is a need for a system to determine a player's level of skill by removing the element of chance from a game.

It is an object of the invention to provide a system for determining a player's level of skill in a game having an element of chance.

It is another object of the invention to provide a system for quantifying the success of a player against other similarly situated players.

It is yet another object of the invention to provide a tournament setting removing the element of chance from a game of skill.

These and other objects of the invention will become apparent to one of ordinary skill in the art after reviewing the disclosure of the invention.

SUMMARY OF THE INVENTION

A system for determining the skill of a player eliminates the element of chance by comparing players who are governed by the same element of chance. In the case of card games, the element of chance is the order of cards and players have the same initial hand. In tile games, the players use the same initial distribution and arrangement of tiles. A player with a less than advantageous initial position may win a game over an opponent having a better initial position. It cannot conclusively be said whether this win is due to the good play of the winner or the bad play of the loser. However, it can clearly be said that the winning player has a higher skill level than the losing player.

To accurately gauge the skill of a player, that player is only compared to other players having the same initial position, with this group of players playing against a common group of opponents. To further diminish the effect of chance on the outcome of the game, each player plays an opponent several times and then the opponents are rotated so that those players ranked against each other have all played the same opponents at the end of a tournament.

DETAILED DESCRIPTION OF THE INVENTION

The element of chance is present in many types of games. The most obvious is card games where the initial hand dealt to a player has a profound impact on the player's ability to win the hand. The game of chance also occurs in tile games with the distribution and initial arrangement of tiles. Also, any game or task incorporating the roll of dice to dictate the manner in which a player can move pieces, such as Backgammon, has the element of chance. Most games have numerous variations. For purposes of this application, generic names are used and some variations on the generic games specifically mentioned. It is to be understand that all variations of these games or tasks are applicable to the system of the invention.

One of the most popular types of card games played throughout the world is poker. Variations of poker include draw poker, Seven Card Stud, Five Card Stud, Hold-Em, and Spit in the Ocean. Another popular card game is Rummy which includes variations such as Gin Rummy, Oklahoma Gin, 500 Gin, Michigan Rummy and Canasta. There are also games that belong to the Euchre family, which include Euchre, Three Hand (Cut Throat) Euchre, Five Card Loo and Hasenpfeffer. The group of card games that belong to the Hearts group include Straight Hearts, Joker Hearts and Omnibus Hearts. There is also the Stops family which includes Michigan, Saratoga, Commit and Player Pay. The All-Fours family includes the Basic Game, California Jack, All Fives, and Pitch and Pedro. Pinochle, Auction Pinochle, Partnership Auction Pinochle and Firehouse Pinochle belong to the Big Bezique family. Miscellaneous card games include Skat, Royal Casino, Cribbage and Frog. Casino gambling games include Black Jack and Baccarat.

Tile games having an element of chance include Dominos, Mahjongg, the Block Game, All Threes, Bergen and Matador.

Board games having a game of chance usually present in the roll of a dice dictating the manner in which a player may move include Backgammon, Acey-Deucy, Scrabble®, Boggle, Yahtzee® and Upwards®.

When organizing a tournament run according to the disclosed system, players are separated into groups. Each group is ranked separately and each member of the group has the same initial starting point for the games by virtue of being governed by the same element of chance. In card games, this translates into the same hand and in games using dice, one roll of die is used for all players within the group. This is often referred to as seat position as seat position determines the order of play and the order of dealing. The term seat position is not restricted to the physical sense of the term since the system can be practiced with computers or over the Internet.

Tournaments are arranged with groups being established and members of one group playing against members of at least one other group. The number of groups depends on the number of players for each individual game. In Backgammon this number is necessarily limited to two, whereas with games such as Black Jack, the number can vary. The game proceeds with the element of chance eliminated by using identically arranged decks of cards, resulting in players within a group having the same as every other player in the group, the same roll of dice or spin of the dial.

One remaining variable within the games is the skill of the players opponent. If two above-average, but evenly skilled, players are paired together, it is likely that these two players will split the number of games played, giving the appearance that both players are of average ability. Within the same tournament, an average player can be paired against a weaker player and win a majority of games giving the impression that the average player has above average ability. To account for this variable, each player in the group plays the same opponents. The opponents are rotated, but players in a group never play each other. In the previous example, the above average player will also play the below average player and win more games against this opponent than the average player. By rotating players and playing a plurality of games against each individual opponent, a basis for ranking players within a group based on skill emerges.

In an average scenario, a group will consist of ten players and each game will consist of three matches against an opponent before rotating opponents. Under this system, scoring for the tournament, upon completion, will be as follows:

The game is played between two players, designated North and South players, until completion. After all of the tables have completed their round, the players are rotated until each North player has played each South player to complete the game. It is important to use identically arranged decks and to have each North player play each South player because although North players oppose their South player opponents, they are being scored against the other North players. North players are ranked against each other and the South players are ranked only against each other.

The game concludes when all rounds have been played. Approximately thirty hands are played to complete the game. With ten tables, each North player plays each South player three times. With twenty-eight players, they will be made into two sections of seven tables each having two pairs and play four hands per round for seven rounds, therefore playing 28 hands, but North will still play all South players. At the conclusion of the game, a score for each hand is calculated and then match pointed. Match points prevents one bad game by a player resulting in enough points for his opponent that the number of points lost makes it difficult, if not impossible, for that player to overcome the loss and give them a chance of winning. In this way, one hand will not determine the outcome of the game. It is possible to get Gin and catch the opponent with 98 points. With a bonus of 25 points for going Gin, one player can accumulate 123 points for the one hand. If we add spades as the 21st card, this could amount to 246 points for one hand.

To calculate match points, the number of pairs in the field of the game is subtracted by one to arrive at a point total. For ten pairs of players, the top score for a hand would be nine. At the conclusion of each game between pairs, the highest North score is awarded nine and the remaining players are given the next sequential number until the lowest North score receives zero. At the conclusion of the game, the Match points accumulated by a player are tallied and the North players and South players are ranked separately by total Match points. With thirty hands being the standard number of hands played, the usual highest possible score is 270.

Winners of the games are awarded Points of Accomplishment which are accumulated over time. The number of Victory Points awarded for winning or placing in a game is determined as follows: One tenth of a Victory Point is designated for each table in the game. If ten tables were playing, there would be one tenth, times ten, equals one Victory Point. If 15 tables were playing, one tenth, times 15, equals 1.5 Points. One tenth of a point for each table in the same section. Forty percent of the North players and 40% of the South players in the game receive some number of Victory Points. The North player who comes in first and the South player that comes in first in a ten table game, each receive one full Victory Point, second place for North and South receive 0.50 point, third gets 0.25, and fourth gets 0.13 Points. If two or more players tie, the points for their two place finishes are added and split between the players. Awarded points are rounded up to the nearest whole number. Since 40% of the players receive points, it is best to have the number of tables being a multiple of five. If the number of tables is not a multiple of five, the number of tables is multiplied by 0.4 and rounded to the nearest whole number. For instance, if 14 pairs were in the game, the number 14 is multiplied by 0.4 and the results, 5.6 is rounded up to six, and the top six North and the top South players receive points. If 13 pairs were playing, 13 is multiplied by 0.4 and the result, 5.2 is rounded to five, and the top five players receive points.

Points of Achievement awarded and accumulated over time allow players to achieve different levels of expertise. In addition to accumulating points for games, points earned at more competitive tournaments (multiple games), are granted special favor. These points are designated with a color to result in a pigmented points system. Points won at a local game or the Internet are black, those at sectionals are black and silver, regionals are designated as black and gold, and nationals black, gold and platinum. Points won at year end eliminations would be designated diamond. Certain levels based on accumulated points will require certain pigmented points in addition to total points. In the preferred embodiment, a rookie will have 0–5 points of any color, a novice player will have 5–20 points of any color, a junior Master will have 20–50 points of any color, a club Master will have 50–100 points of any color. A sectional Master will need up to 200 points of which 25 will be silver, a regional Master will require up to 250 points of which 25 will be silver, 25 gold. A national Master will have 300 points of which 25 are platinum, 25 are gold and 25 are silver. A Grand Master, the highest level, will require 500 points and five diamond points, 25 platinum points, 25 gold points and 25 silver points.

Although the accumulation of points and the levels of achievement that are won show some level of expertise, the winning average that a player is credited with will be used to designate the various stratified levels that a player may participate in. Under this system, in a large game, players at the lowest level can complete against players at the highest level yet be scored against players at their same level. In a large game there will be players of different ability, it will be possible for players to compete against others at the same level of ability, or play in open game against one another. At the conclusion of a game, all players are ranked. Under this initial ranking, players of the highest level compete not only against like players, but also against players of a lower level. A secondary scoring lists all players except those at the highest level. This scoring continues until only the players at the lowest level are ranked by themselves.

Under such a system, a player in a lower level is able to earn points if, at that game, they earn a better score than players at a higher level.

In an example of how an open game operates, suppose a game is conducted with 15 total pairs with the North players, ranked against each other, not against the South players. If there are five players in strat A, five players in strat B, and five players in strat C. At the conclusion of the game, the 15 players are ranked sequentially from top to bottom. For the highest strat, all 15 players are ranked and 40%, six players, receive Points. These points are awarded to the top six players over all, regardless of strat. The top four players of the ten players not in the highest stratification are ranked separately with four of those players, 40% of the ten players, receiving Points. Lastly, the five players in the lowest stratification are ranked with the top two players receiving Points based on the five players qualifying in this stratification. In this way, players can earn points in a higher stratification, but not in a lower stratification.

With the larger number of players being ranked in the upper strat, one and one half Points are available for first place whereas in the second stratification, with only ten players being considered, one Gin Point is available and in the lowest stratification, with only five players competing, one half Gin Point is available. If a player earns points in more than one stratification, they are able to choose whichever point total is higher. In this instance, a B player winning the overall game will finish first in the overall standing, and also first overall when the B level is ranked. Having earned one and one half points for the A stratification and 1 point in the B stratification, that player would receive the higher total, one and one half points.

Another method to provide a level playing field between players of different abilities is to use a handicapping system within a handicapped game. Under a handicap system, a player has points added to his score based on that player's average score and a percentage of the maximum number of points possible in a game. For instance, 270 points is the usual maximum score based on 30 hands with ten players, making nine points the maximum value per hand. If an average player would have scored 135 points, a handicap can be calculated as the difference between that player's average score and a percentage of the maximum score. In the preferred embodiment, the percentage of the maximum score is 60% since the top 40% of the players earn points. In the above-mentioned example, a player having an average score of 135 out of 270 would have a handicap of 27 calculated as 60% of 270 minus 135. If a game is played with other than 30 hands, the handicap can be changed proportional to the difference between the standard 270 maximum points and the maximum number of points available in that particular game.

The system of the invention provides for conducting duplicate games with multiple pairs. The scoring of individual matches is tallied and based on the scores for each individual player during game, players are ranked and Points are awarded. Points are accumulated over time and different levels of accomplishment are achieved. The different levels of winning averages allow for stratified games. An alternative to stratified games is to provide each player with a handicap so that players of different abilities can complete on a somewhat level playing field. With the use of Points won, a winning average as well as a handicap system, players of every level and ability can play and have a reasonable expectation of winning some number of points.

The system can be applied to games having any number of players, each player belonging to a separate group. In the case of single player games, such a Mahjongg, all players use identically arranged tiles. Players are ranked on time to complete the game or percent of the game complete before no further moves are possible.

The system of awarding Victory Points and Points of Accomplishment can be applied to many fields of endeavor. One such field is auctions. Having several people participate in the same auction allows the skill of each participant to be determined and quantified. This is true because each item at auction has an appraised value. Participants will bid up until what they perceive to be the appraised value. Only one participant will be successful in buying the item. If the final price is below the appraised value, other participants stop bidding too early. If the winning bid is above the appraised value, the winning bidder should have stopped bidding. By comparing a participants winning bid versus appraised price, that participant's skill can be quantified. With many participants at the same auction, all participants are on an equal footing. At the conclusion of an auction, the amount underbid or overbid can be tallied and ranked with the person underbidding by the most amount getting ranked first with the participant overbidding by the most amount getting ranked last. This activity can be broken down into subcategories, such as bidding on furniture, antiques, and other appropriate categories. After the auction, if one person finds that they consistently underbid in one category, they are doing well in that category, but if overbidding in another category, are not doing too well. With this type of feedback, the participant knows in which areas they need to improve their appraisal skills so as not to bid above the appraisal price.

In a similar vein, the ability to pick stocks is much like an auction. Participants starting with the same amount of money can pick and choose which stocks to purchase. When they believe the stock price is less than true value, they will purchase that stock. The future price of the stock determines whether they were correct in their assessment. Participants making the most money over a certain period of time in their stock can be ranked first, while people losing the most money can be ranked last. Similar to auctions, the types of stocks can be separated into categories such as technology stocks, utility stocks, small cap, large cap and mid cap. By breaking down the stocks into categories, participants can gauge their skill in appraising stocks in a particular category. If stocks in technology center do well, they know that their skill in appraising stocks in that area is adequate, while if they consistently lose money in a sector such as utility stocks, they now know that their skill needs improvement in that category.

Once skill is determined and ranked. they can be quantified. When an endeavor is broken down into categories, such as auctions or stocks, participants can use their performance relative to other participants to know in which categories they need improvement.

Variations and modifications of the invention would be apparent to one of ordinary skill in the art. The number of Match Points awarded for play between pairs and Points awarded to the winners of a game could be altered without deviating from the spirit and scope of the invention. The invention covers variations and modifications which would be apparent to one of ordinary skill in the art.

I claim:

1. A method of playing a game comprising choosing a game having an element of chance, separating participants into at least two groups, forming a plurality of individual games, each game having only one participant from each group playing against each other, after each game rotating the participants to match different members of said at least two groups and playing a new game with new matches, continuing to rotate participants after each game until every participant in one group has played every participant in another group at least one game group, using the same element of chance for each individual game, said element of chance comprises one of the steps of the dealing of hands of cards from a deck of playing cards, the rolling of a die or the spinning of a wheel.

2. The method of claim 1, further comprising electronically generating said element of chance.

3. The method of claim 1, wherein said game is backgammon, blackjack, or poker.

4. The method of claim 1, wherein said participants play over the internet.

5. A method of playing a game, comprising choosing a game having an element of chance, separating participants into at least two groups, forming a plurality of individual games, each game having only one participant from each group playing against each other, using the same element of chance for each individual game, said element of chance comprise one of the steps of the dealing of hands of cards from a deck of playing cards, the rolling of a die or the spinning of a wheel, playing at least one game and after each game rotating the players to match different members of said at least two groups, and playing at least one game with the new matches, and continuing to rotate participants after each game and playing at least one game until every player in one group has played every player in another group at least one game.

6. The method of claim 5, further comprising ranking the players in each group only against each other.

7. The method of claim 6, further comprising calculating a winning percentage and handicap for each player.

* * * * *